United States Patent [19]

Martin

[11] Patent Number: 4,924,609

[45] Date of Patent: May 15, 1990

[54] DIGGING TOOTH AND TEETH ARRAYED IN COMBINATION WITH ENDLESS EXCAVATING CHAIN

[75] Inventor: J. Scott Martin, Perry, Okla.

[73] Assignee: The Charles Machine Works, Inc., Perry, Okla.

[21] Appl. No.: 282,518

[22] Filed: Dec. 12, 1988

[51] Int. Cl.[5] ..... E02F 3/14; E02F 5/06

[52] U.S. Cl. ..... 37/191 A; 37/142 R; 30/381; 83/851; 83/853

[58] Field of Search ..... 37/83, 86, 191 R, 191 A, 37/192 R, 192 A, 141 T, 142 R, 142 A; 30/381, 384, 385, 386; 83/851–855

[56] References Cited

U.S. PATENT DOCUMENTS

| | | | |
|---|---|---|---|
| 979,597 | 12/1910 | Teller | 299/84 |
| 2,048,702 | 7/1936 | Joy | 299/84 |
| 2,519,075 | 8/1950 | Schmidt | 37/86 |
| 2,589,914 | 3/1952 | Wolf | 30/384 |
| 2,645,471 | 7/1953 | King | 262/33 |
| 2,714,773 | 8/1955 | Stewart | 37/86 |
| 2,817,167 | 12/1957 | Barber | 37/86 |
| 3,790,353 | 2/1974 | Jackson et al. | 37/141 T |
| 3,834,049 | 9/1974 | Bond | 37/86 |
| 3,846,922 | 11/1974 | Horton | 37/83 |
| 3,979,843 | 9/1976 | Nissen | 37/86 |
| 3,991,494 | 11/1976 | Schuermann et al. | 37/90 |
| 4,475,604 | 10/1984 | Albertson et al. | 175/85 |
| 4,571,859 | 2/1986 | Leischer | 37/142 R |
| 4,651,449 | 3/1987 | Rose | 37/191 R |
| 4,713,897 | 12/1987 | Hemphill | 37/83 |

*Primary Examiner*—Randolph A. Reese
*Assistant Examiner*—Arlen L. Olsen
*Attorney, Agent, or Firm*—Laney, Dougherty, Hessin & Beavers

[57] ABSTRACT

An L-shaped digging tooth includes a trapezoidally configured shank having inner and outer sides. A toe portion projects laterally from one of its edges. An angle of about 90°±30° is defined between the general plane of the toe portion and the plane of the shank. The shank and toe portion terminate in a common, continuous cutting edge of L or V-shaped configuration having a convex outer boundary and a concave inner boundary. This cutting edge intersects at a leading cutter point, a free inner edge of the toe portion which extends along a line convergent with the shank portion plane. The tooth is hard-faced over a zone adjacent the common leading edge. The invention further relates to an endless chain excavating assembly which includes the described L-shaped teeth arrayed in a specific sequence with, and geometric relationship to, cup-shaped teeth of a known type, with both secured at spaced intervals to an endless chain.

16 Claims, 5 Drawing Sheets

DIGGING TOOTH AND TEETH ARRAYED IN COMBINATION WITH ENDLESS EXCAVATING CHAIN

FIELD OF THE INVENTION

This invention relates to metal teeth used by mounting them on an endless chain and continuously driving the chain to force the teeth into the earth, and thereby form a trench or ditch. The invention relates more specifically to a novel metal tooth configuration and construction, and to a unique array of a plurality of teeth mounted at spaced intervals along an endless chain. The teeth and chain are used in combination for digging a trench or ditch when the chain is continuously powered to force the teeth into the earth.

BACKGROUND OF THE INVENTION

Brief Description of The Prior Art

A number of types of trenching or ditching machines have previously been devised, and many of them have been commercialized and are currently in use. One type of machine used for forming trenches and ditches is a machine which relies upon an endless, sprocket driven chain which has mounted along its length, a plurality of digging teeth. These teeth operate by a scraping and gouging action to form a trench or ditch as the chain is forced downwardly into the earth, and then moved laterally. The teeth mounted on the chain function to perform both a ditch or trench extension function at the face or leading end of the trench or ditch, and also a trench widening or side wall forming function as a result of the earth removal action of the teeth scraping against the opposed sides of the trench.

One type of tooth used on such endless chains for the purpose of excavating the earth as the chain is continuously driven in rotation by sprockets is the tooth which is illustrated in Nissen U.S. Pat. No. 3,979,843. The Nissen teeth are generally U-shaped in configuration, and are used in an array in which the teeth are faced in alternate directions in their spacing along the chain upon which they are mounted, and are utilized in a trenching operation.

A relatively flat, though slightly concave, generally rectangular digger tooth is shown as it is mounted on an endless chain-type trencher mechanism illustrated in Stewart U.S. Pat. No. 2,714,773. In the Stewart arrangement of teeth on the endless chain, alternate teeth are affixed to opposite sides of the chain, and are faced in opposite directions.

A kerf cutting chain is illustrated in U.S. Pat. No. 2,048,702. The teeth employed on this endless chain are sharply pointed, slightly angled teeth which are arrayed at varying angles with respect to the chain axis in a repeating pattern along the chain.

Trapezoidally-shaped teeth having points oriented to be directed against the face of a continuously projected trench are illustrated in U.S. Pat. No. 3,991,494 as mounted at spaced intervals along the endless chain of an excavating machine.

Another trenching machine is illustrated and described in U.S. Pat. No. 2,817,167. This trenching machine utilizes U-shaped teeth secured at spaced intervals along an endless chain. The teeth are cupped inwardly and then outwardly in alternating sequence. In the words of the patentee, the digger teeth project outwardly and laterally from certain links of the endless chain, and are formed to dig into the ground and carry the earth upwardly out of the ditch.

Cup-shaped teeth having a wide leading edge and a diminished trailing edge at the end of a trapezoidally-shaped principal plate are shown in Horton U.S. Pat. No. 3,846,922. Here the teeth are mounted upon a continuous or endless ditcher chain, and each tooth in the array of teeth along the chain appears to be substantially identically oriented with respect to the axis of the chain.

Cup-shaped or C-shaped teeth which are alternately faced inwardly and outwardly along the length of an endless chain employed in a trenching apparatus are illustrated and described in Albertson U.S. Pat. No. 4,475,604. This patent describes a mobile trenching machine, and the cup-shaped teeth here illustrated as mounted upon the endless chain of the trenching machine are of a widely used, commercially available-type.

A somewhat similar cup-shaped tooth which includes a shank portion for mounting to an endless chain, and a cup-shaped upper cutting portion extending out from the shank portion, and carrying a cutting edge, is shown in Schmidt U.S. Pat. No. 2,519,075. In the Schmidt patent, the teeth are, in each case, faced toward the central axis of the chain. Stated differently, the convex outer side of each tooth faces toward the trench wall and away from the axis of the chain.

One of the advantages which is said to characterize the cup-shaped teeth or blades used on the endless chain of the Schmidt patent is that these teeth completely eliminate the need for buckets or spades in order to elevate to the surface, the particles of earth which have been cut away from the walls and face of the trench. The cutter blades, or teeth, are placed on the endless chain in alternately right and left hand array—that is, a right hand cutter blade is affixed to the chain, followed by a left hand cutter blade, with the right and left hand cutter blades or teeth being secured to opposite sides of the chain and thus opening inwardly in each case. The shank plate which is provided serves as an integral part of the chain. Each of the cutter teeth has a sharply tapered or sharpened leading edge and a trailing edge. Conventional roller chain pins extend through the apertures formed in the mounting shank portions on the cutter blades or teeth.

Generally L-shaped cutter teeth are mounted on an endless chain used in a mining machine described and illustrated in Teller U.S. Pat. No. 979,597. The pointed short leg of the "L" is oriented forward approximately parallel to the chain axis. The shank portions of the teeth used in the Teller mining machine are mounted on a central axis of the endless chain, and are arrayed in sets of three teeth. The angulation of each tooth of the three varies slightly with respect to the axial plane of the chain. Tooth function is generally of the "point attack" or "pick" cutter type.

Another type of generally angled or V-shaped cutter tooth developed for utilization in mining machines is that which is illustrated in U.S. Pat. No. 2,645,471 to King. This tooth also has the pointed short leg of the "V" oriented forward approximately parallel to the chain axis, and tooth function is generally of the "point attack" or "pick" cutter type. The leading face or edge of the cutter tooth of King carries a bead of overlay metal which is a self-hardening material made up of a selected balance of alloy metals. The fused overlay of abrasion resistant alloy extends along a certain critical area on the cutter bit or tooth to aid in preventing wear and reduction of the working height of the tooth in a short period of time.

BRIEF DESCRIPTION OF THE PRESENT INVENTION

The present invention, in one aspect, is an improved digging tooth especially suited for securement to, and use in combination with, an endless, continuously driven chain of the type used in a trench or ditch excavating machine. In another aspect, it is believed that a novel and inventive combination is constituted by the tooth of the invention mounted upon the type of flexible, endless chains used in trenching machines. In yet another aspect of the invention, the described improved and unique digger tooth is used in a certain array of teeth in which several of the teeth are of the new type, and others are of the conventional, presently used cup-shaped configuration. Improved results are realized through the use of the improved tooth and the described tooth array, all as will hereinafter be more specifically alluded to and described in greater detail.

Broadly described, the digging tooth of the present invention is generally L-shaped in configuration and includes a relatively flat or monoplanar shank portion which is preferably trapezoidal in configuration, and is provided principally for affixing thereto, or forming integrally therewith, the cutting portion of the tooth, and for securing the entire tooth to the lateral mounting plate or tooth station of an endless chain. The shank portion of the digging tooth of the invention is preferably apertured to facilitate affixation of the tooth to the endless chain. It should be pointed out that with some types of endless trencher chains the shank portion may vary in shape, and the tooth may be secured to the chain by other means.

A toe portion projects laterally from one of the edges of the shank portion, and at least the toe portion and preferably at least a part of the shank portion carry beveled, sharpened leading edges which function to cut during the ditching operation of the chain. The leading edges of the shank portion and toe portion are in coplanar alignment with each other and define, as a result of the angulation of the toe portion laterally away from the shank portion, an angle of from about 60° to about 120°. The toe portion of the digger tooth is also preferably trapezoidally configured and has a trailing edge which is in coplanar alignment with, and intersects, the trailing edge of the shank portion.

The L-shaped digging tooth of the invention presents a number of advantages. Its configuration allows it to afford better collective action when arranged in an array of teeth as hereinafter described. Moreover, the L-shaped digging tooth is more easily manufactured because it is of a simpler configuration than the cup-shaped teeth hereinbefore widely used. It can be quickly and easily mounted on a conventional endless trencher chain of the sprocket driven type, and it can be used in any desired combination or array with other types of trencher chain teeth now in use.

The tooth carries an area of hard-facing adjacent at least a part of the sharpened leading edges thereof, and this hard-faced zone is preferably located in a generally rectangular band extending parallel to the leading edges. The configuration of the tooth is such that the hard-faced part of the tooth lasts longer, and the loading on the leading cutting edges of the tooth is more effectively distributed over a greater area than in prior types of teeth used for trenching and ditching. For this reason, in many soil conditions, the tooth enjoys a substantially extended service life over which it will continue to efficiently shear the face of the trench.

In another aspect of the invention, in which the L-shaped digging tooth is arrayed in a selected grouping with presently used and conventional cup-shaped teeth, a leading pair of the L-shaped teeth are provided on the endless chain and are secured thereto so that the toe portions of the teeth turn inwardly toward the central axis of the chain. These first two teeth thus overlap so that the leading tooth protects the second tooth in the first pair. A second pair of the L-shaped teeth is then attached to the chain with the toe portions facing outwardly. Finally, at least one pair of the conventional cup-shaped teeth are secured to the chain following the last pair of L-shaped teeth of the present invention, with the convex, outer sides of these cup-shaped teeth facing outwardly and the leading edges thereof used primarily for scraping away, and working upon, the lateral or side walls of the trench as the trench is extended.

The described array of two pairs of the improved L-shaped teeth of the invention, followed by a pair of the conventional cup-shaped teeth, has been found to outperform several types of tooth groupings which are now utilized on endless chains in conventional trenching machines. Further, while facilitating significant improvement in the rate of trench propagation (digging speed), the teeth, when arrayed in accordance with the present invention, also afford extended service life, and continue to perform effectively long after the teeth used in trenching machines which are presently commercially available have become worn to the point of uselessness.

It is pointed out that although the described tooth array has been found to be highly effective in certain types of soil, improved performance is also to be derived from various other combinations in which the generally L-shaped teeth of this invention are used for shearing away the face of the trench and varying numbers of generally cup-shaped teeth are mounted on the chain at various intervals therealong and function to cut away the side walls of the trench and thereby determine the trench width.

An important object of the present invention is, as will be perceived from the foregoing description, to provide a trenching or ditching machine which can successfully excavate a trench or a ditch faster in many types of soil than many trenching machines which are presently available.

Another object of the invention is to provide an improved digging tooth for use on endless chains employed in trenchers, which tooth can be easily and relatively inexpensively manufactured, but which exhibits an extended service or operating life, and performs effectively over a long period of time.

A further object of the invention is to provide an improved array of digger teeth mounted upon an endless chain for trenching or excavating purposes, with the array being such that a plurality of the L-shaped teeth of the present invention do substantially all of the high pressure scraping and digging work at the trench face, and a plurality of cup-shaped teeth perform the gauging or trench-width determining function.

A further object of the invention is to provide an array of the L-shaped teeth of the present invention, in combination with conventional cup-shaped teeth, in which the L-shaped teeth tend to protect the cup-shaped teeth at their tip or leading edge areas, and prevent rapid loss through wear of the hard-facing end portion of the cup-shaped teeth.

A further object of the invention is to provide an array of cutter or digging teeth for use on an endless chain employed in a trencher, with the tooth array being such that the teeth are effectively protected against loss of profile height for an extended period of time.

Another object of the invention is to provide an improved L-shaped tooth which is configured so that when it is mounted on an endless chain employed in a trenching machine, it presents to the trench face an elongated sharpened cutting edge bounded by a hard-faced area, instead of a relatively small area, or point zone, and thus distributes over a larger area, the high pressure applied to the tooth in scraping away the trench face, thereby increasing the rate of excavation and extending the wear life of the tooth.

A further object of the invention is to provide an improved digger or cutter tooth for mounting on an endless trencher chain, from which improved tooth, it is easier to clean cut and to remove impacted dirt than teeth of the configurations in which such teeth have previously been manufactured.

Additional objects and advantages of the invention will become apparent as the following detailed description of certain preferred embodiments of the invention is read in conjunction with the accompanying drawings which illustrate such preferred embodiments of the invention.

GENERAL DESCRIPTION OF THE DRAWINGS

FIG. 1 is a front elevation view of the digging tooth of the invention. A right hand tooth adapted to be mounted on one side of an endless chain of a trencher apparatus is here illustrated. A left hand tooth which would face the opposite way on the page of drawings is not illustrated, but is preferably included in any tooth array in which the teeth of this invention are used. The right and left hand teeth are identically constructed except for facing in opposite directions (mirror images) when mounted on opposite sides of the endless chain.

Figure 7A:
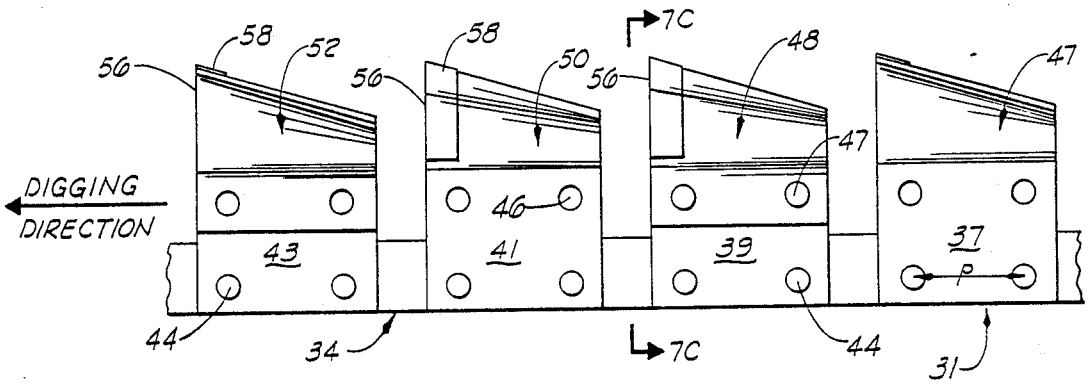
FIG. 7A is a side elevation view of a portion of an endless chain having secured thereto, cup-shaped teeth of a type heretofore utilized on such chains, and showing a four tooth array of such cup-shaped teeth as utilized on the chain.
Figure 7B:
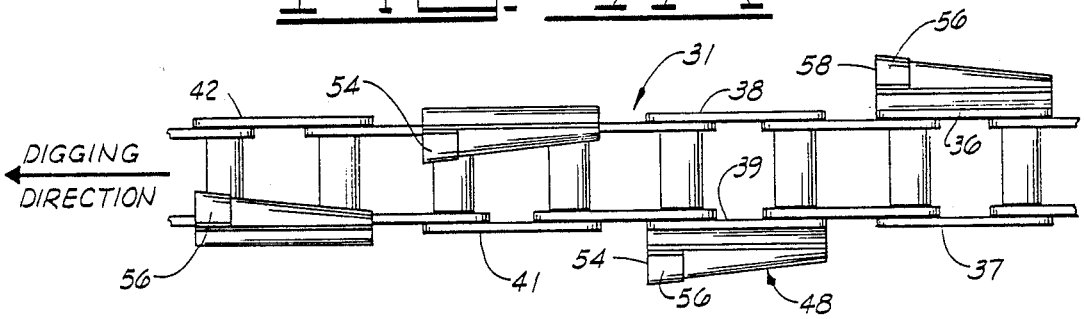
FIG. 7B is a plan view of the endless chain and cup-shaped tooth array used on the chain as shown in FIG. 7A.
Figure 7C:
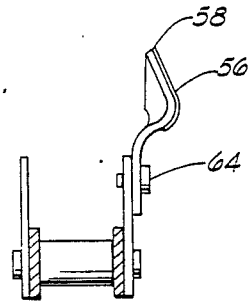
FIG. 7C is a sectional view taken along line 7C—7C of FIG. 7A.
Figure 9:
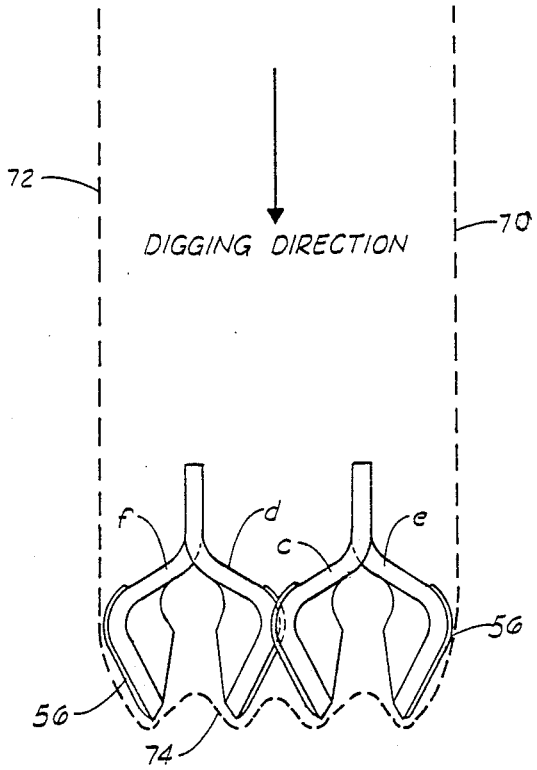

FIG. 9 schematically illustrates the cutting pattern developed in a trench forming operation by a chain which carries a plurality of the previously used cup-shaped teeth thereon in the pattern or array shown in FIGS. 7A–7C. The walls and face of the trench are illustrated by a dashed line.

Figure 10:
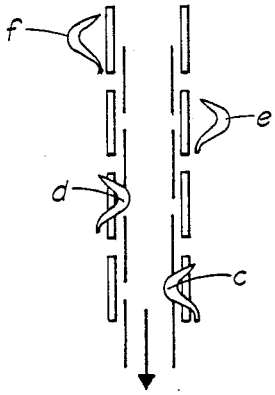

FIG. 10 schematically further illustrates the way the cup-shaped teeth are oriented with respect to the inside and outside of an endless chain upon which the teeth are mounted. The chain is any suitable type of endless chain used in a trenching or ditching machine.

Figure 11:
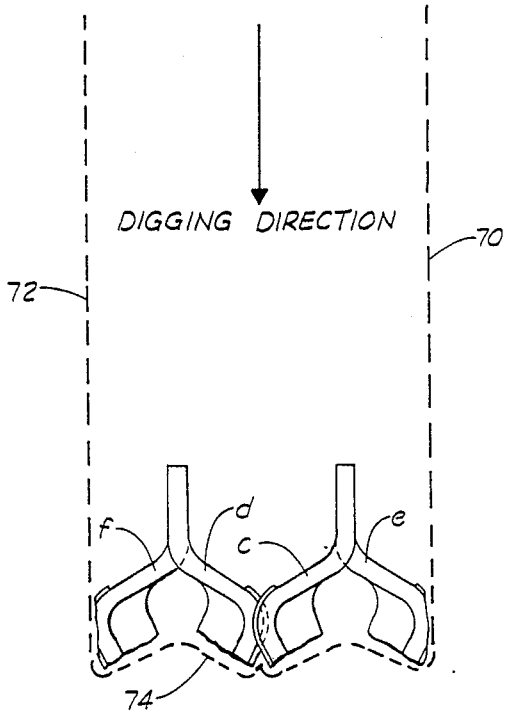

FIG. 11 is a schematic illustration of the trenching which is effected through the action of the prior art cup-shaped teeth arrayed along the chain as shown in FIG. 10, but after the leading edges or points and cutting edges of the teeth have been worn away as a result of extended usage. The walls and face of the trench are illustrated by a dashed line.

Figure 12:
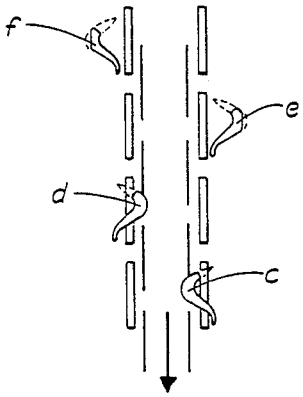

FIG. 12 is a schematic plan view of the tooth arrangement on the endless chain showing the appearance of the teeth after a cutting edge part of each tooth has been worn away through extended use. The zone of tooth wear is shown in dashed lines.

Figure 13:
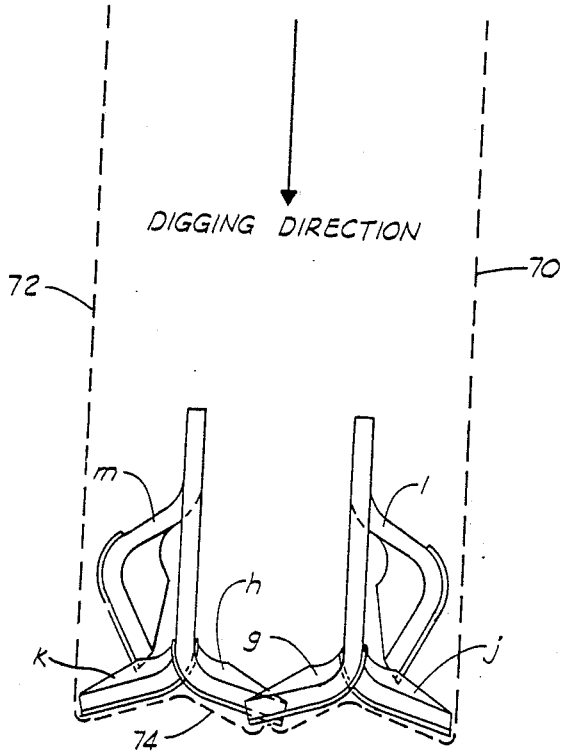
Figure 14:
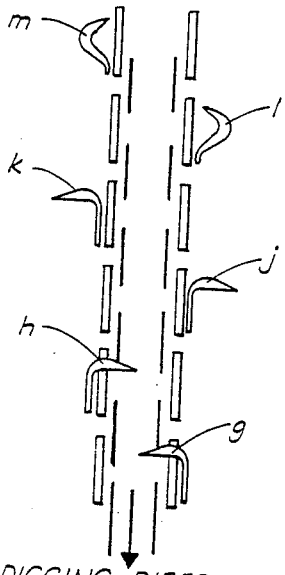

FIG. 13 and FIG. 14 illustrate the trenching action attained by using the tooth array of the present invention mounted upon an endless chain. Such tooth array includes two pair of the novel L-shaped teeth of this invention, used in combination with one pair of the previously known cup-shaped teeth.

FIG. 14 schematically illustrates the tooth array of the present invention in which the novel L-shaped teeth of the present invention are arranged in combination with the cup-shaped teeth previously utilized in an arrangement in which the teeth are located at spaced intervals along the length of an endless chain.

Figure 15:
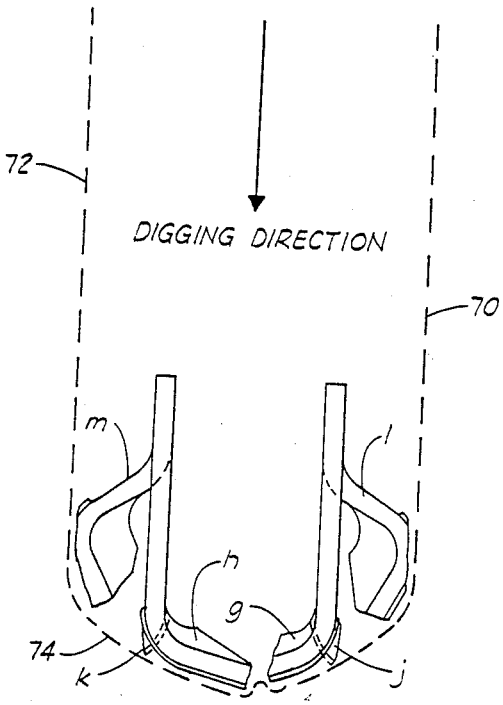
Figure 16:
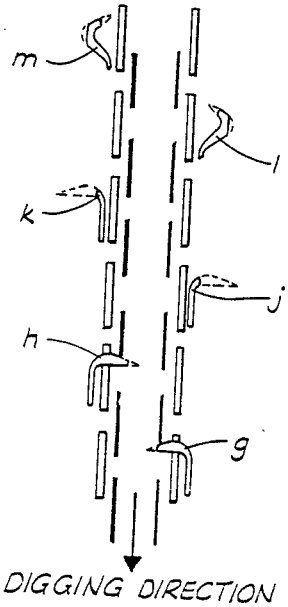

FIG. 15 and FIG. 16 schematically illustrate the cutting action realized from the tooth array shown in FIGS. 13 and 14 after portions of the teeth have been worn away through extended usage of the excavating assembly which includes the endless chain.

Figure 17:
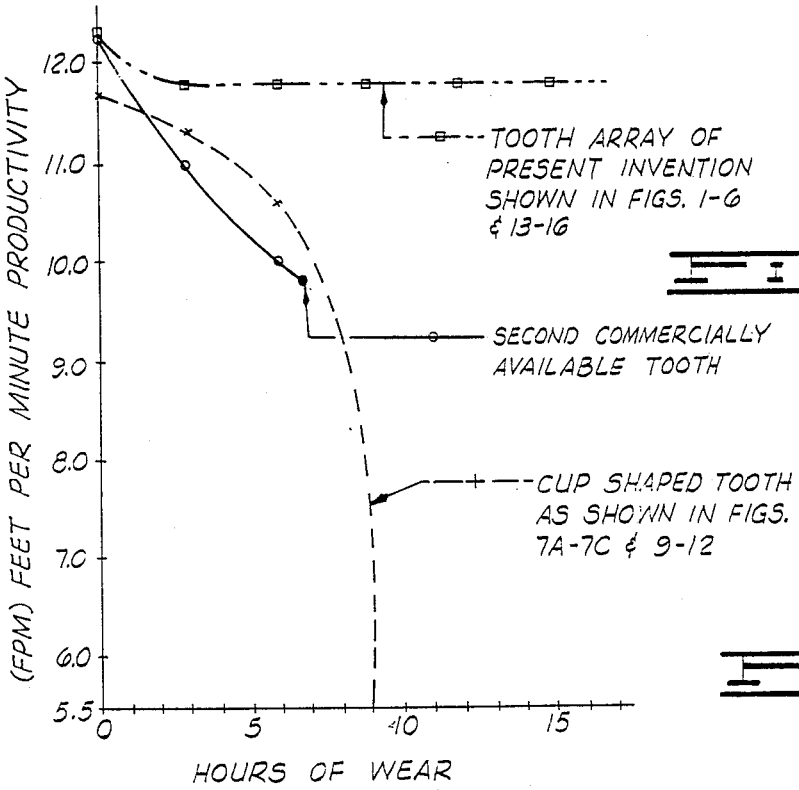

FIG. 17 is a graph which illustrates the wear life and trench cutting rates, in feet per minute, of three types of endless chain and tooth arrays as evaluated in comparative trenching tests. The test soil was an abrasive sandy loam occurring near Phoenix, Ariz.

Figure 18:
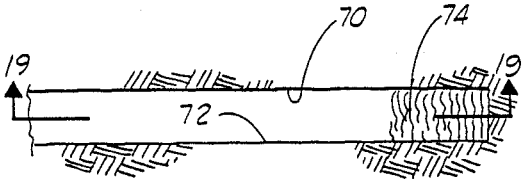

FIG. 18 is a plan view of an elongated trench of the type which may typically be excavated, using an endless chain trencher of the type to which reference will be hereinafter made.

Figure 19:
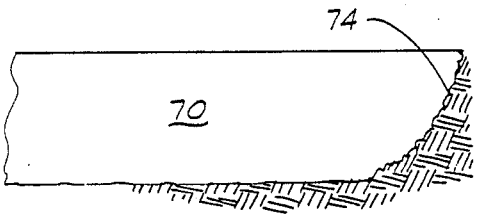

FIG. 19 is a sectional view taken along line 19—19 of FIG. 18.

Figure 20:
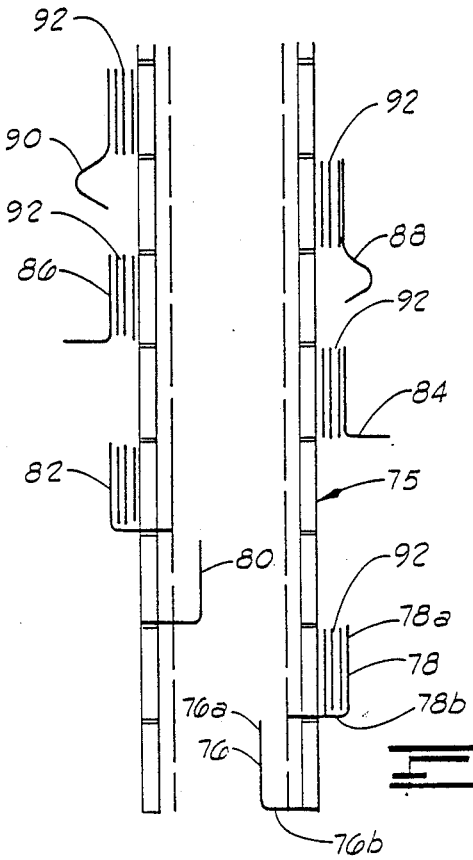

FIG. 20 is a schematic view illustrating a different arrangement of teeth along a portion of an endless chain, showing the tooth pattern in this particular array, as such pattern and array include L-shaped teeth of the present invention and cup-shaped teeth of the type previously used.

Figure 21:
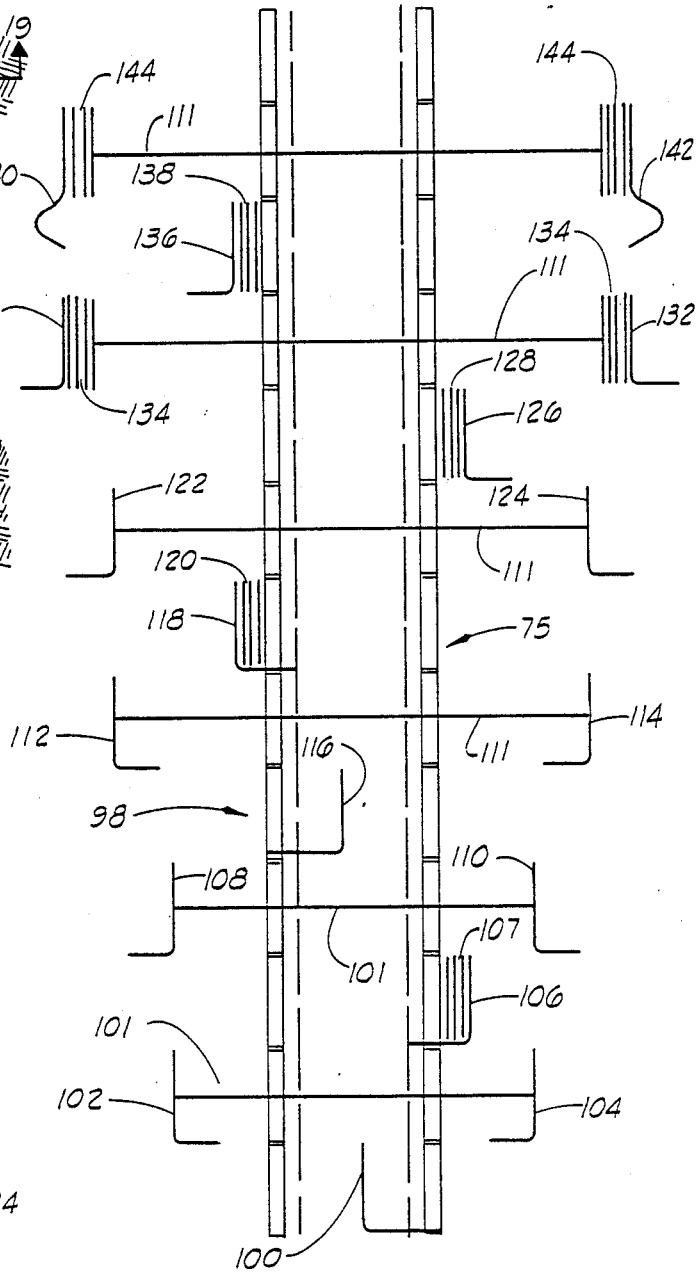

FIG. 21 is a schematic illustration of an arrangement of teeth along an endless chain where the teeth have been mounted on the chain to provide a trench or ditch of very substantial width as a result of the arrangement of the teeth relative to each other upon the chain.

DETAILED DESCRIPTION OF A PREFERRED EMBODIMENT OF THE INVENTION

Figure 1:
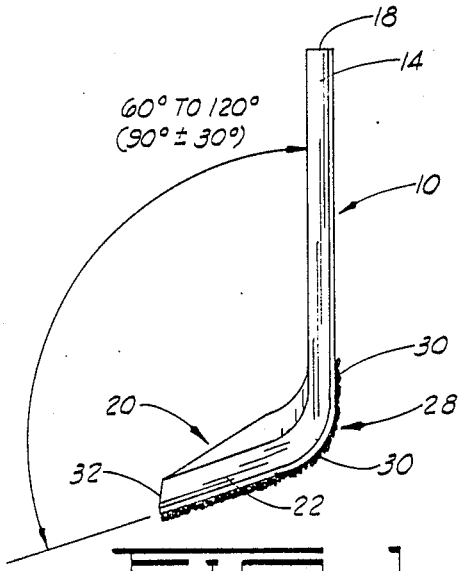
Figure 2:
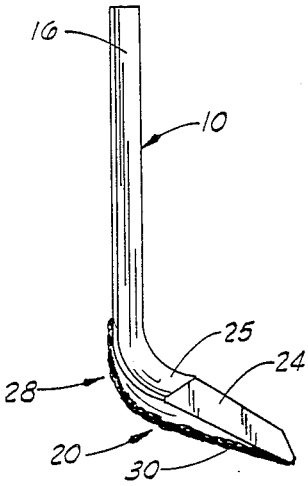
FIG. 2 is a rear elevation view of the right hand digging tooth of the invention.
Figure 3:
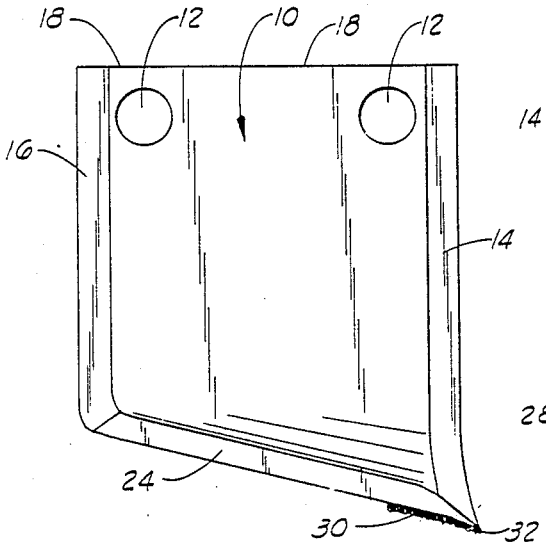
FIG. 3 is a side elevation view of the digging tooth.

Referring to FIG. 1, the L-shaped digging tooth of the invention has an apertured shank plate or portion 10 which, in the illustrated embodiment, is of generally trapezoidal configuration as shown in FIG. 3. The shank plate 10 defines a plurality of apertures 12 which permit the tooth to be attached to an endless chain of the type typically used in ditching or trenching machines. Examples of such endless chains are to be found in U.S. Pat. No. 3,991,494, in U.S. Pat. No. 4,475,604 and U.S. Pat. No. 3,570,152. The shank plate preferably carries a tapered or beveled, sharpened leading edge 14 and may optionally have a tapered trailing edge 16, although it is not critical that either edge of the shank plate be tapered or sharpened. The leading edge 14 and the trailing edge 16 preferably extend normal to a straight chain securement edge 18.

Figure 5:
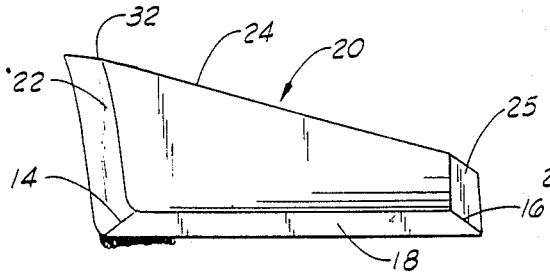
FIG. 5 is a bottom plan view of the digging tooth of the invention.

At its side opposite the chain securement edge 18, the shank 10 is bent through an angle of from about 60° to about 120° to form an outwardly or laterally extending cutting portion or toe portion, designated generally by reference numeral 20. In a preferred embodiment the toe portion lies generally in a plane which extends at an angle of about 105° to the shank portion. The toe portion 20 has a beveled or sharpened leading cutting edge 22 which is continuous with, and extends in a common plane with, the leading edge 14 of the shank 10. The toe portion 20 terminates in a free lateral edge 24. The lateral edge 24 extends between the leading edge 22 of the toe portion and a trailing edge 25 of the toe portion which may be beveled as shown. As will be perceived in referring to FIGS. 5 and 6, the toe portion 20 is also preferably of trapezoidal configuration in the illustrated embodiment, and the lateral edge 24 thereof extends from the widest part of the toe portion to its narrowest part at the trailing or rear edge thereof.

Figure 4:
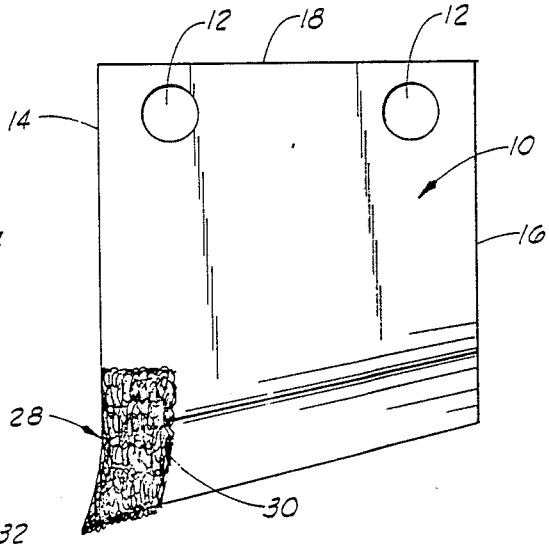
FIG. 4 is a view in elevation of the opposite side of the digging tooth from that which is shown in FIG. 3.
Figure 6:
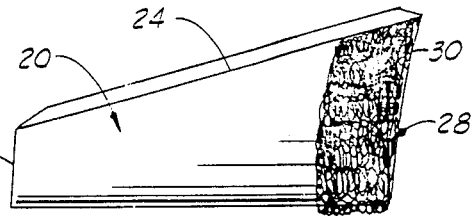
FIG. 6 is a top plan view of the right hand digging tooth of the invention.

Positioned along the convex or outer side of the tooth at a location which commences at a point along the sharpened leading edge 14 near the bend of the plate, a hard-faced area or zone is formed, and is denominated generally by reference numeral 28. The hard-faced area or zone 28 includes a matrix of weld metal in which are bonded and adhered, a plurality of particles of tungsten carbide or titanium carbide or ceramic material. A bead of chromium carbide can also sometimes be used. The preferred shape and location of this band of hard-facing is best illustrated in FIGS. 1, 4 and 6 of the drawings. There it will be seen that the weld metal matrix and abrasion resistant particles extend from the leading tip 32 of the L-shaped tooth, and project along the convex back or outer side of the tooth to a location just past the bend of the leading edge of the tooth. The hard-faced band, or zone 28 is generally rectangular in configuration in the illustrated embodiment, and may typically have a front-to-back width, as measured along a line extending between the leading edge and trailing edge of the tooth, which is about fifteen to thirty-five percent of the total width of the tooth. The band of hard-facing 28 will be perceived to be positioned adjacent, and to extend substantially parallel to, the leading edge 22 and a part of the edge 14 immediately adjacent the leading edge 22.

FIGS. 7A and 7B illustrate the manner in which cup-shaped digging teeth of a type previously in use are secured to an endless chain 34 of one type which is typically used in a ditch or trench excavating machine. Other types of endless chains (not here shown) are also sometimes used on trencher machines. The endless chain 34 is driven so that the teeth carried thereon are caused to contact the ground, and to dig a trench or ditch as the chain continues to be rotated. The leading teeth located at the forward end of the trench bite into the face of the trench, shear the earth therefrom and cause the trench to be extended. Some of the teeth on the chain also assure that the width of the trench is sized according to a predetermined dimension by scraping or shearing the opposite side walls of the trench.

As shown in FIGS. 7A and 7B, the endless chain 34 includes a plurality of opposed, parallel tooth station chain bars, with those chain bars carried on one side of the chain being denominated by the even reference numerals 36, 38, 40 and 42. On the opposite side of the chain, the tooth station chain bars are denominated by odd numbers 37, 39, 41 and 43. It will be perceived in referring to FIG. 7A that each of the tooth station chain bars is of generally rectangular configuration, and includes a pair of chain rivet receiving apertures 44 adjacent a lower edge thereof to permit the chain bars to be secured to the transverse links of the chain 34 in conventional fashion. Near the upper side of each of the tooth station chain bars, the bar carries a pair of apertures 46 used for bolting the digger teeth thereto. The heads of bolts used for this purpose are denominated by reference numeral 47.

The distance between the centers of adjacent chain rivets is referred to as the pitch of the chain, and this dimension is depicted in FIG. 7A, and is there denominated by the letter "p". The pitch of the chain provides a reference parameter useful for establishing the height of chain tooth needed for most effective functioning. The importance of tooth height is further discussed as reference is hereinafter made to FIG. 8 of the drawings.

In the arrangement illustrated in FIGS. 7A and 7B, the conventional digger teeth are, as previously indicated, of cup-shaped configuration. Each tooth includes an apertured shank portion which facilitates the attachment of the cup-shaped digger tooth to the respective tooth station chain bar or plate of the chain. The several teeth which are illustrated are denominated generally by reference numerals 47–52, and as illustrated, are mounted to alternately opposite sides of the chain and consecutively face in alternate directions.

In referring to FIG. 7B, it will be noted that the teeth are mounted so that the relatively long, leading, cutting edge 54 of each tooth faces in the direction of travel of the endless chain, which is the direction of digging. The appearance in end elevation of one of the old and conventional teeth shown in FIGS. 7A and 7B is illustrated in FIG. 7C. Here, it will be noticed that the portion of the tooth extending from the apertured shank portion is generally cup-shaped in configuration. It will further be noted that a zone of hard-facing 56 of the type hereinbefore described extends around the convexly curved portion of the cup-shaped part of each tooth to the tip 58 of the tooth.

In referring to FIGS. 7A and 7B, it will be noted that, as the cup-shaped, presently known cutting teeth 47–52 are mounted on the endless chain 31, the teeth are mounted in alternate pairs, with the cup and cutting edge facing inwardly toward the chain axis in the case of the first pair, followed by the next tooth pair in which the hard-facing and cutting edge face outwardly to the outside of the chain. This arrangement has been found to constitute the generally most effective arrangement of teeth where the cup-shaped teeth presently in use are the only type of teeth employed on an endless chain for trench or ditch excavating.

Where the heretofore utilized cup-shaped teeth of the type shown in FIGS. 7A–7C are employed, and the repeating four tooth sequence or array there shown is employed on an endless chain, the teeth are subjected to wear at certain critical points during operation of the excavating machine. Thus, the tips of the teeth, hard-faced along one of the sides, strike the trench face and scrape away at it, while the curved outer or convex sides of the cup portion of the cup-shaped teeth shear and shape the trench walls. The width of the trench is determined by the cutting effect of this convex outer side of the cup-shaped portion of the teeth.

The heavy loading or high pressure exerted on the points of the teeth at their leading edges, as these points cut away at the face of the trench, causes the hard-faced portion of the teeth to wear very quickly. Only a small area of the hard-facing is highly loaded, and is subjected to the greatest wear. Therefore, the tips of the cup-shaped teeth wear away quickly, and function to only slightly continue to protect the other teeth in the array as the chain is driven through the soil. The tips of all of the teeth along the chain soon wear into a rounded, shortened shape which reduces the excavation rate. In the case of the outside teeth, that is, those which face outwardly from the outer sides of the chain, the tips of these teeth function to do the scraping work at the trench face. The curved or convex outside surfaces of these same teeth function to shape the side walls of the trench. Wear thus concurrently occurs at the forward and the outer sides of the tooth profile, and the tooth profile is rapidly reduced or lowered, and the excavation rate is concomitantly markedly decreased.

Figure 8:
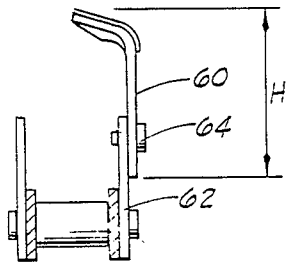
FIG. 8 is a sectional view similar to FIG. 7C, but illustrating, instead, the mounting to the endless chain of one of the L-shaped teeth of the present invention.

Before discussing further the manner in which the cup-shaped teeth now in use wear when forming a trench or ditch, FIG. 8 can be used to compare the manner in which the L-shaped teeth of the present invention are secured to the tooth station chain bars forming a part of the endless chain used in a typical trenching machine. Thus, as shown in FIG. 8, an L-shaped tooth 60 of the present invention is shown mounted on one of the tooth station chain bars 62 by means of suitable bolts or rivets 64. In this particular illustration, the L-shaped tooth is shown with the cutting edge and point facing inwardly from the side of the chain toward the chain axis, but as will be hereinafter explained, in a preferred array of these teeth on an endless chain, pairs of the L-shaped teeth are alternately faced outwardly and inwardly along the chain, and are preferably, though not necessarily, used in combination with the cup-shaped teeth hereinbefore described.

As has been mentioned above, the height of the L-shaped teeth of the invention is important in relation to the pitch, p, of the chain upon which the teeth are to be mounted. By the tooth height is meant the distance from the securement edge 18 to the edge 24 measured parallel to the plane of the shank portion 10. This dimension is shown in FIG. 8 and is there denominated by reference letter "H". The tooth height to chain pitch ratio (H/p) is preferably from about 1.4 to about 2.5. Typical tooth height and chain pitch dimensions are shown in Table I.

TABLE I

| Pitch | Tooth Height |
|---|---|
| 1.654 | 3.25 ± 0.90 |
| 2.000 | 3.90 ± 1.10 |
| 3.067 | 6.00 + 1.70 |
| 4.500 | 8.80 ± 2.50. |

The manner in which the cup-shaped teeth wear when secured to the endless chain in the pattern described (and illustrated in FIGS. 7A and 7B) is schematically illustrated in FIGS. 9–12 of the drawings. In FIGS. 9 and 11, the side walls of a trench being excavated are schematically represented by the parallel dashed lines 70 and 72 extending vertically on the page. Such a trench is also illustrated in FIGS. 18 and 19 where the walls of the trench are again denominated by reference numerals 70 and 72, and the trench face is denominated by reference numeral 74. The trench face 74 is shown being contacted and scraped away by the cup-shaped teeth which are arranged in the tooth array shown in both FIGS. 9 and 10. It will be noted that the teeth which are in advance, are the ones which are turned inwardly on the chain, and these are denominated in FIGS. 9–12 as teeth "c" and "d". The next two teeth in the array are turned outwardly and are denominated as teeth "e" and "f". The hard-facing on the convex outer sides of the leading or cutting edge of the cup-shaped teeth is, as previously stated, denominated by reference numeral 56 in these drawings.

In FIGS. 11 and 12, the effect of severe wear on the teeth is illustrated. It will be noted that the inside teeth, "c" and "d", are only slightly protected by the teeth "e" and "f" which are turned outwardly. The high pressure work done by the teeth at the trench face is done principally by the points which are very heavily loaded, and therefore quickly become dulled and round, or shortened. The hard-facing is quickly worn away from the end over a small area.

In FIGS. 13–16, the novel preferred tooth array of the present invention is illustrated. It will be perceived, in referring to FIG. 14, that a first pair of the L-shaped teeth "g" and "h" is arranged so that the two teeth have their toe portions extending inwardly on the endless chain, and that the two teeth in the first pair are staggered or offset in an axial or longitudinal direction along the chain. The next pair of L-shaped teeth, "j" and "k", have their toe portions pointing outwardly from the sides of the chain, and are also staggered longitudinally along the chain. Finally, the array is completed by the inclusion of two of the cup-shaped teeth of the type presently known. These are mounted to trail the four L-shaped teeth of the present invention, with these conventional cup-shaped teeth being oriented so that the convex side and the cutting edge thereof are faced outwardly away from the chain.

In this arrangement, the L-shaped teeth "g" and "h" at the leading side of the array contact the trench face over a relatively large area (as compared to the conventional array of cup-shaped teeth) along an elongated hard-faced edge (compare FIGS. 9 and 13). The cup-shaped teeth "l" and "m" shape the trench walls. Stated differently, the cup-shaped teeth "l" and "m" are the gauge teeth which establish the width of the trench. The principal wear area of the leading pair of L-shaped teeth "l" and "m" is along the extended line of hard-facing which is provided. By reason of the distribution of the load over this increased area, (as compared to the small tip area of the cupped teeth) which contacts the leading face of the trench, a combination of increased excavation rate and much longer wear life is realized in many types of soil, and under many excavation conditions.

It will be noted in referring to FIG. 13 and 15 that the leading, inwardly turned L-shaped tooth, "g", protects the second, inwardly turned L-shaped tooth, "h", from severe end or tip wear. This protection enables the second tooth in the array to continue to dig and to exhibit extended wear life so that the overall wear life of the entire system is thereby increased. This continued effective functioning of the second tooth, "h", in the array continues even after the other three L-shaped teeth in the two pairs of L-shaped teeth have become worn to the point of non-function (as shown in FIG. 15).

The two outwardly facing L-shaped teeth, "j" and "k", (the second pair of teeth in the total array of six teeth) function to protect the cup-shaped teeth as well as the two inside L-shaped teeth. These outwardly facing L-shaped teeth "j" and "k" are the first to become worn to the point of ineffectiveness. At this time, the maintenance of the tooth profile height becomes the function of the two inwardly facing L-shaped teeth, "g" and "h". The tooth profile height (as determined by the distance the tooth has worn down) is directly proportional to the excavation rate within the height range used by the device. The cup-shaped teeth, over the greater portion of their effective wear life, function principally for shaping the side walls of the trench and gauging the trench width. The tooth tips of these cup-shaped teeth, "l" and "m", are protected by the outwardly facing L-shaped teeth "j" and "k". On three of the six teeth, the hard-facing is protected from end wear by the interference afforded by the leading teeth.

For the purpose of evaluating the novel L-shaped teeth of the present invention as mounted upon the powered, endless chain of a trench or ditch excavating machine, certain comparison tests were performed in the desert near Phoenix, Arizona. The machines utilized in the test were each Ditch Witch® trencher machines manufactured by The Charles Machine Works, Inc. of Perry, Okla. Several arrays of digger teeth were mounted on the endless trenching chains. In one array of teeth, the conventional, cup-shaped digging teeth of generally C-shaped configuration constructed and mounted upon the chains as shown in FIGS. 7A–7C of the drawings were utilized. There was also utilized in another tooth array, a second type of competitive digger tooth manufactured by another company, and currently commercially available. This tooth is hereinafter referred to as tooth X and tooth array X. It is also a generally cup-shaped tooth, and these teeth were arranged in alternating (facing in-facing out) pairs along the chain similarly to the array of C-shaped teeth.

Finally, the L-shaped teeth were arrayed with C-shaped teeth in the two pair—one pair arrangement illustrated in FIGS. 13–16 of the drawings. The thus arrayed teeth were then mounted on the endless chain in the manner shown in FIGS. 7C and 8.

In the course of these tests, the trencher machine was run in third gear at an engine speed of 2700 rpm. The speed at which the chain was driven was 400 feet per minute. The virgin desert ground which was excavated contained essentially no rocks of any significance, but was highly abrasive.

The results of these comparative tests in the Arizona desert are graphically portrayed in FIG. 17 of the drawings. In this graph, the hours of wear to which the several types of tooth arrays were subjected in the testing prior to the failure of the teeth is indicated on the abscissa, and the digging rate in feet per minute, as a measure of the productivity of the respective teeth, is shown on the ordinate.

The graph in FIG. 17 clearly shows that in the case of each of the two commercially available tooth arrays, including the C-shaped cupped teeth of the type shown in FIGS. 7A–7C, the teeth did not have an effective service life, or continue to function effectively, beyond about six to nine hours of usage. When the L-shaped teeth of the present invention were used in combination with the C-shaped teeth in the array illustrated in FIGS. 13 and 14, however, the teeth continued to function effectively, though badly worn, even after twenty-five hours of wear and use. The test was terminated after that time period due to the occurrence of rain. At that time, even though the teeth in the array of the invention were badly worn, they were still able to effectively trench in this particular soil structure, and to project the trench at a rate of slightly less than 12 feet per minute. Neither of the previously known commercially available teeth types were able to match this rate of trench projection beyond the third hour of use.

As previously pointed out, a number of advantages characterize the use of the teeth of the present invention on an endless chain employed in trench or ditch excavation. Thus, the L-shaped teeth have been found to have superior and extended wear life as compared to the cup-shaped teeth shown in FIGS. 7A and 7B. Moreover, by the use of the teeth of the present invention, a higher digging rate, in terms of projection of the ditch or trench in feet per minute, is realized. The teeth are not difficult to manufacture, and they can be made from flat bar stock which is bent and beveled using simple manufacturing operations. Importantly, for many soil conditions the tungsten and titanium carbide or ceramic particles and entire hard-faced area is more efficiently used on the L-shaped teeth of the present invention than on the cup-shaped teeth heretofore in use. The teeth are easier to mount by reason of their simple geometric configuration, and they are easier to clean following an excavating operation. They can be used, where advantage results, in various combinations with other types of teeth, including the cup-shaped teeth previously used on trenching and excavating machines of the type described.

From the foregoing description of a preferred embodiment of the digger tooth of the invention, and of a preferred array of digging teeth mounted on, and used in combination with, an endless chain of a trenching or ditching machine, the basic principles which underlie the present invention can be perceived. It will be understood that the foregoing presentation and description has been illustrative in character, and is not intended to limit or narrowly define the invention by reason of the precise terms used, structures cited or relative arrangements or geometric configurations described. For example, other combinations of the L-shaped teeth of the invention with the now-known cup-shaped teeth can be devised without sacrifice of a significant measure of advantage over any array which includes only the cup-shaped teeth. Also various ways and means for securing the teeth to endless, flexible chains of different types may be utilized.

FIGS. 20 and 21 schematically illustrate other arrays of teeth which can be employed on an endless chain 75 for the purpose of forming a wider trench than that which can be excavated with the teeth arranged in the patterns previously discussed and illustrated in foregoing figures.

In FIG. 20 an eight tooth pattern is illustrated in which there are, initially, six of the L-shaped teeth, 76, 78, 80, 82, 84 and 86, of the present invention mounted in a particular pattern to provide mutual interference to minimize wear on the following or trailing teeth. Two of the cup-shaped teeth of the type previously utilized, 88 and 90, follow the six L-shaped teeth. It will be noted that in the case of the first two of the L-shaped teeth which are mounted on the chain, the first of the teeth 76 has a shank portion 76a mounted internally on the chain, with the cutting portion or toe portion 76b extending transversely from the inner side of the chain, across the chain in an outwardly facing direction. The immediately following tooth 78 is mounted on the outer side of the chain by the use of three spacer plates or bars 92. The tooth 78 is mounted so that its cutting portion 78b faces inwardly toward the central axis of the chain. It will thus be noticed that the cutting portions 76b and 78b of the first and second teeth overlap so that the leading L-shaped tooth 76 breaks ground ahead of, or "runs interference for", the next L-shaped tooth 78, thereby protecting the second tooth from rapid and excessive wear early in the use of tooth array and chain.

The same pattern or overlapping characteristic will be perceived in the third and fourth teeth 80 and 82, which are both L-shaped teeth, and are mounted on the opposite side of the chain from the number one and number two teeth (76 and 78). Again, the number three tooth, 80, has its cutting or toe portion 80b projecting transversely in an outwardly facing direction. This cutting portion 80b affords interference for, or protection of, the cutting portion 82b of the number four tooth 82. The series of three spacer plates or bars 92 are disposed between the chain links and the shank portions of each of the second tooth 78, fourth tooth 82 and fifth tooth 84 so that these teeth are spaced further outwardly relative to the axis of the chain. They thus function to afford the capability for excavating a wider trench than a chain which carries a tooth array thereon similar to that shown in FIGS. 13–16 and hereinbefore described.

The arrangement of the fifth and sixth of the L-shaped teeth, 84 and 86, relative to each other, and relative to the following cup-shaped teeth 88 and 90 (the seventh and eighth teeth), is the same as the relationship between these several teeth as such are illustrated in FIGS. 14 and 16 of the drawings. In FIG. 20, however, the fifth and sixth L-shaped teeth are spaced outwardly from opposite sides of the chain by means of the series of three spacer plates 92 utilized in the case of the mounting of each of the L-shaped teeth 84 and 86. This sets the cutting or toe portions of the teeth further outwardly from the central axis of the chain and, as previously described, enables a wider trench to be cut with the apparatus. The two cup-shaped teeth 88 and 90 which complete the array are also offset laterally by means of spacer plates 92. Three spacer plates 92 are used in the case of each of these cup-shaped plates.

FIG. 21 of the drawings shows an eighteen tooth array in which the several teeth in the pattern are arranged along the chain 75 so as to be able to excavate a trench having a width of 25.5 inches. Within this pattern there are sixteen of the L-shaped teeth of the present invention, followed by two opposed cup-shaped teeth of the type frequently utilized in prior art practice and hereinbefore described. The chain 75 has affixed thereto at the leading end of the chain (the movement of the chain 75 is toward the bottom of the page as it is portrayed in the drawing), one of the L-shaped teeth of the present invention. This leading L-shaped tooth is secured to the inner side of the chain and is denominated by reference numeral 100. A rigid, mechanically sturdy adapter 101 is then secured across the chain (typically by bolting or welding) rearwardly from the L-shaped tooth 100, and has a pair of L-shaped cutting teeth 102 and 104 secured at the outer opposite ends thereof. The L-shaped teeth 102 and 104 have the blade or toe portions turned inwardly toward the chain and the shank portions are secured to the rigid, transversely extending adapter 101. The spacing between the L-shaped teeth, 102 and 104, in the illustrated embodiment of the invention, can typically be about twelve inches.

The next tooth secured to the chain 75 is also an L-shaped tooth, and is denominated by reference numeral 106. The tooth 106 is secured to the outer side of the chain 75 by the use of three flat spacer plates or bars 107 which are each approximately one/half inch thick. In the depicted arrangement, the L-shaped tooth 106 has its cutting or toe portion extending inwardly toward the center of the chain. It will be noted by reference to FIG. 21, that the toe or cutting portions of the L-shaped teeth 100 and 106 are placed in an interfering status so that the toe portion of the leading tooth 100 provides protection or interference, thereby shielding the toe portion of the tooth 106 so that early abrasive wear on this tooth is less severe.

The next tooth pair is a pair of the L-shaped teeth 108 and 110 which are secured at the outer ends of another standard transversely extending adapter bar 101. The two L-shaped teeth 108 and 110 secured to the opposite outer ends of the standard adapter bar 101 have the toe portions turned outwardly, as illustrated in FIG. 21. As in the case of the adapter bar used to carry the teeth 102 and 104, the adapter bar 101 which carries the two teeth 108 and 110 is typically about twelve inches in length.

A longer adapter bar 111 is used to support the next pair of transversely aligned L-shaped digger teeth 112 and 114. This adapter bar 111 which carries the teeth 112 and 114 at its outer ends is typically about 18 inches in length in a typical mounting arrangement. It will be noted, in referring to FIG. 21, that the L-shaped teeth 112 and 114 have their toe portions turned inwardly toward the chain, and that they are in a position of interference with, or being shielded by, the outwardly turned toe portions of the L-shaped teeth 108 and 110.

Mounted on the inside of the chain with its toe portion turned outwardly is a single L-shaped tooth 116. This particular L-shaped tooth 116 is positioned so that its toe portion leads, and provides protection for, the toe portion of an L-shaped tooth 118 which is secured to the outer side of the chain by a plurality of spacer plates 120 and is mounted to have its toe or cutting portion facing inwardly toward the longitudinal axis of the chain.

A pair of outwardly facing L-shaped cutter teeth 122 and 124 are mounted next on the chain and are secured to the opposite ends of another elongated adapter bar 111 having a typical length of about eighteen inches. The teeth 122 and 124 are transversely aligned across the chain by reason of their common mounting on their adapter bar. They are followed by an L-shaped tooth 126 secured to the outer side of the chain by the use of spacers 128, and having its toe portion facing outwardly away from the chain. It will be perceived that the toe portion of the tooth 126 will track behind the toe portion of the tooth 104.

The next two pairs of L-shaped teeth are denominated by reference numerals 130 and 132. These teeth 130 and 132 are each secured to the outer side of the outermost of three spacer bars or plates 134. The spacer plates 134 are secured, in sets of three, to the opposite ends of another of the elongated adapter bars 111 which is welded to the chain to extend transversely across the chain at this location, and has a length of about eighteen inches. The adapter bar and spacer plates 134 together cause the L-shaped teeth 130 and 132 to be separated by about twenty-five inches.

The next tooth secured to the chain is the L-shaped tooth 136. It is mounted to the chain by means of three spacer bars 138. The tooth 136 has its toe portion facing, or extending, outwardly from the chain, and this causes it to track behind the tooth 102 located near the forward end of the tooth array, and to be protected in its early wear life by the toe portion of the tooth 102.

The final pair of teeth utilized in the tooth array shown in FIG. 21 are a pair of cup-shaped teeth of the type heretofore in use. These teeth are denominated by reference numerals 140 and 142. The cup-shaped teeth 140 and 142 are each mounted at the opposite ends of an elongated adapter bar 111 which extends transversely across the chain at this location. Spacing the teeth outwardly from the ends of the adapter bar are two sets of three spacer plates 144 utilized in the case of each of the teeth 140 and 142. This gives the total span of teeth in a transverse direction of about twenty-five inches, and permits a trench of this width to be dug through the use of this tooth array.

Having pointed out the operating and functional principles of the invention, it is believed that variations of structures and forms which do not alter or depart from the operating principles of the invention can be devised without difficulty by those skilled in the art. All such changes and innovations are deemed to be circumscribed by the spirit and scope of the invention. The claims, while defining these principles in certain selected words, will be understood to also have a certain elasticity of construction which permits their spirit and intended scope to be expanded as may be needed to protect the invention, and the clear implications of, or extrapolations from, the structures and structural relationships hereinbefore set forth.

What is claimed is:

1. A digger tooth for use upon an endless digger chain, said tooth comprising:

a substantially monoplanar shank portion of generally trapezoidal configuration having an inner side, an outer side, a leading edge, a trailing edge shorter than, and extending substantially parallel to, said leading edge, a third edge extending substantially normal to the leading and trailing edges and a fourth edge longer than said third edge and extending between said trailing edge and said leading edge;

a toe portion of generally trapezoidal configuration projecting laterally from the plane of the shank portion and connected to the shank portion along the fourth edge thereof, said toe portion including an inner side, an outer side, a beveled, sharpened leading cutting edge intersecting, in coplanar alignment with, and defining an obtuse angle of about 105° with, the leading edge of said shank portion, said toe portion further including a trailing edge intersecting, and in coplanar alignment with, the trailing edge of said shank portion; and a hard-faced zone of abrasion resistant particles in supporting, bonding weld metal, said hard-faced zone extending along a portion of the outer side of said shank portion, and along the outer side of said toe portion, and lying in a continuous band adjacent, and extending parallel to, the leading cutting edge of the toe portion, and also lying adjacent, and extending parallel to, a portion of said leading edge of said shank portion.

2. A digger tooth as defined in claim 1 wherein said abrasion resistant particles are a material selected from the group consisting of tungsten carbide, titanium carbide and ceramic.

3. A metallic digger tooth comprising:

a L-shaped metal plate which includes a shank portion and a toe portion extending from an edge of the shank portion and generally forming an angle of from about 60° to about 120° with the shank portion, said metal plate having an L-shaped leading edge extending along the shank portion and along the toe portion, said leading edge having a sharpened cutting portion extending along said toe portion; and a first rectangular band of hard-facing positioned adjacent, and having one edge colinear and coextensive with, the portion of said leading edge extending along the toe portion of said plate; and a second rectangular band of hard-facing extending from one end of said first band along a portion of said L-shaped leading edge which extends along said shank portion wherein said hard facing is selected from the group consisting of titanium carbide, tungsten carbide, and ceramic material.

4. A metallic digger tooth as defined in claim 3 wherein said shank portion is trapezoidally configured and includes, in addition to said leading edge, a trailing edge which is shorter than, and extends parallel to, said leading edge, and a third edge which extends normal to said leading and trailing edge, and a fourth edge from which said toe portion extends.

5. A metallic digger tooth as defined in claim 3 wherein said hard-facing is abrasion resistant particles selected from abrasion resistant materials consisting of titanium carbide, tungsten carbide, and ceramic material.

6. A trenching chain assembly for use in a trenching machine and comprising:

an elongated, endless chain having opposite sides and having a lengthwise aspect and a width, and having a centrally disposed longitudinal axis extending along its length between opposite sides of the chain, said chain including a plurality of interconnected, articulated links having spaced, tooth mounting plates each adapted to support a digging tooth, said tooth mounting plates being located on opposite sides of the longitudinal axis of the chain; and an array of digging teeth secured to, and projecting from the chain, the array of digging teeth including a repeating pattern of six digging teeth spaced along the chain, said six digging teeth including:

a first L-shaped leading tooth secured to one of said tooth mounting plates on one side of the chain, said first L-shaped leading tooth including:

a shank portion secured to said one tooth mounting plate; and a toe portion secured to said shank portion and projecting across the chain toward the side of the chain opposite the side upon which said one tooth mounting plate is located, said toe portion and said shank portion forming an angle of from about 60° to about 120° with each other, and each having a beveled, sharpened, leading cutting edge on a side thereof facing in the direction in which the chain is moving;

said six digging teeth in the repeating pattern further including:

a second L-shaped tooth spaced along said chain from said first leading L-shaped tooth in the opposite direction from the direction in which said chain is moved during digging of a trench, said second, L-shaped tooth being secured to a second of said tooth mounting plates located on the opposite side of said chain from said first tooth mounting plate and spaced in an axial direction along the chain from said first tooth mounting plate, said second L-shaped tooth including:

a shank portion of said second L-shaped tooth secured to said second tooth mounting plate; and a toe portion of said second L-shaped tooth secured to the shank portion of said second L-shaped tooth and projecting across the chain toward the side of the chain opposite the side upon which said second tooth mounting plate is located, and opposite the direction of projection of the toe portion of said first, leading L-shaped tooth, said toe portion of said second L-shaped tooth and said shank portion of said second L-shaped tooth forming an angle of from about 60° to about 120° with each other, and each of said shank portion and said toe portion of said second L-shaped tooth having a beveled, sharpened, leading cutting edge on a side thereof facing in the direction in which the chain is moving, said second L-shaped tooth having a part of its toe portion positioned behind, and shielded by, a part of the toe portion of said first L-shaped tooth at a location relatively near to the longitudinal axis of the chain whereby said first L-shaped tooth undergoes wear while protecting a portion of the toe portion of the second L-shaped tooth over an extended period of time thereby extending the life of the trenching chain assembly;

said repeating pattern of six digging teeth further including:

a third L-shaped tooth spaced axially along said chain from said second L-shaped tooth in a direction away from the direction of movement of said chain during the digging of a trench, and secured to a third of said tooth mounting plates mounted on the opposite side of the chain from said second tooth mounting plate and on the same side of said chain as said first tooth mounting plate, said third L-shaped tooth including:

a shank portion of said third L-shaped tooth secured to said third tooth mounting plate; and a toe portion of said third L-shaped tooth secured to the shank portion of said third L-shaped tooth and projecting outwardly from the chain away from the central longitudinal axis of the chain, said toe portion of said third L-shaped tooth and the shank portion of said third L-shaped tooth forming an angle of from about 60° to about 120° with each other, and each having a beveled, sharpened, leading cutting edge on a side thereof facing in the direction in which the chain is moving;

said repeating pattern of six digging teeth further including:

a fourth L-shaped digging tooth spaced axially along said chain from said third L-shaped digging tooth in a direction opposite the direction of movement of said chain, said fourth L-shaped digging tooth being secured to a fourth of said tooth-mounting plates on the opposite side of said chain from said third L-shaped digging tooth, and on the same side of said chain as said second tooth-mounting plate, and spaced along the chain in an axial direction from said third tooth-mounting plate, said third L-shaped tooth including:

a shank portion of said fourth L-shaped cutting tooth secured to said fourth tooth mounting plate; and a toe portion of said fourth L-shaped cutting tooth secured to the shank portion of said fourth L-shaped cutting tooth and projecting outwardly away from said chain and away from the central longitudinal axis of said chain in a direction opposite the direction of projection of the toe portions of said first and second teeth with respect to the shank portions of said first and second L-shaped teeth, said toe portion of said fourth L-shaped tooth and said shank portion of said fourth L-shaped tooth forming an angle of from about 60° to about 120° with each other, and each having a beveled, sharpened, leading cutting edge on a side thereof facing in the direction in which the chain is moving;

said repeating pattern of siad six digging teeth further including:

a cup-shaped fifth cutting tooth spaced along said chain from said fourth L-shaped cutting tooth in a direction away from said fourth L-shaped cutting tooth and opposite the direction in which said chain moves during digging of a trench, said cup-shaped fifth cutting tooth being secured to a fifth one of said tooth mounting plates disposed on the opposite side of said chain from said fourth tooth-mounting plate, and said cup-shaped fifth cutting tooth including:

a shank portion of said cup-shaped fifth cutting tooth secured to said fifth mounting plate; and a cup-shaped toe portion of said cup-shaped fifth cutting tooth secured to said shank portion of said cup-shaped fifth cutting tooth, said toe portion being of generally C-shaped cross-sectional configuration, said cup-shaped toe portion being oriented to face the convex outer side thereof away from the axis of the chain, and to face the concave inner side thereof toward the axis of the chain, said cup-shaped toe portion having a beveled, sharpened, leading cutting edge on a side thereof facing in the direction in which said chain is moving, and said cup-shaped fifth tooth terminating in a point positioned behind and shielded by a part of the toe portion of said third L-shaped cutting tooth; and said repeating pattern of six digging teeth further including:

a cup-shaped sixth digging tooth secured to a sixth of said tooth mounting plates located on the opposite side of said chain from said fifth tooth-mounting plate and spaced axially along said chain from said fifth tooth-mounting plate and in the opposite direction from the direction of movement of said chain, said cup-shaped sixth digging tooth including:

a shank portion of said cup-shaped sixth digging tooth secured to said sixth tooth-mounting plate; and a cup-shaped toe portion projecting from said shank portion of said cup-shaped sixth digging tooth, having a generally C-shaped cross-sectional configuration, and oriented to present the convex side of said toe portion on the outer side of the cup-shaped tooth away from the chain, and to present the concave side of said cup portion facing inwardly toward the axis of said chain, said cup-shaped sixth digging tooth having a beveled, sharpened, leading cutting edge facing in the direction in which said chain is moving; said cup-shaped toe portion of said cup-shaped sixth digging tooth terminating in a point positioned behind, and shielded by, a part of the toe portion of said fourth L-shaped tooth whereby the efficiency and effective service life of the trenching chain assembly is extended.

7. A trenching chain assembly for use in a trenching machine for digging elongated trenches and comprising:

an elongated, endless chain having opposite sides and having a lengthwise aspect and a width, and having a centrally disposed longitudinal axis extending along its length between opposite sides of the chain, said chain including a plurality of interconnected, articulated links having spaced, tooth-mounting plates each adapted to support a digging tooth, said tooth-mounting plates being located on opposite sides of the longitudinal axis of the chain and generally defining, by their separation, the width of the chain; and an array of digging teeth secured to, and projecting from, the chain, the array of digging teeth including:

at least one trench face shearing tooth mounted on the chain and having a toe portion extending generally transversely with respect to the direction of the travel of the chain during the digging of a trench and projecting either inwardly toward the longitudinal axis of the chain, or outwardly away from the longitudinal axis of the chain, said toe portion being spaced from a plane containing the longitudinal axis of the chain; and means for connecting said toe portion to at least one of said plates of the chain, and for spacing said toe portion from said plane containing the longitudinal axis of the chain, said toe portion including a hard-faced leading cutting edge, with the hard facing thereon including particles selected from the group consisting of titanium carbide, tungsten carbide, and ceramic material; and at least one cup-shaped gauge tooth mounted on the chain and spaced longitudinally therealong from each of the trench face shearing teeth on the chain so as to follow and track at least one of the trench face shearing teeth, each of said cup-shaped teeth including a curved, convex outer side facing away from the longitudinal axis of the chain and a concave inner side facing toward the longitudinal axis of the chain, said curved, convex outer side being spaced outwardly from a plane containing the longitudinal axis of the chain and adapted for shearing away the side walls of a trench dug by the trenching chain assembly, and thus constituting gauging teeth for gauging the width of the trench; and means for connecting said cup-shaped tooth to at least one of said plates of the chain.

8. A trenching chain assembly as defined in claim 7 wherein said means for connecting said toe portion to at least one of said plates of the chain comprises a shank portion formed integrally with said toe portion and projecting from said toe portion at an angle from about 60° to about 120°, said shank portion including means for securing said shank portion to at least one of the plates of the chain.

9. A trenching chain assembly as defined in claim 8 wherein said means for securing said shank portion to at least one of said plates of the chain comprises:

a plurality of apertures defined by the shank portion and extending therethrough; and bolts extended through the apertures in the shank portion and through cooperating apertures through at least one of said plates of the chain.

10. A trenching chain assembly as defined in claim 7 wherein said means for connecting said cup-shaped tooth to at least one of said plates of the chain comprises:

a shank portion having apertures therethrough; and bolts passed through the apertures in said shank portion and through at least one of said plates of said chain for mounting the cup-shaped tooth on the chain.

11. A trenching chain assembly as defined in claim 7 wherein said array of digging teeth includes:

four of said trench face shearing teeth spaced from each other along said chain and in successive positions along the length of said chain; and at least two of said cup-shaped teeth spaced from each other along the length of said chain and following said four trench face-shearing teeth, said array of shearing teeth and cup-shaped teeth being repeated in a repeating pattern over the entire length of the chain.

12. A trenching chain assembly as defined in claim 7 wherein said array of digging teeth comprises:

a first, leading, trench face-shearing L-shaped tooth mounted on said chain at the leading end of the array in the direction of chain travel, and having a shank portion connected to the inner side of one of said tooth mounting plates on one side of said chain, and having a toe portion extending generally transversely with respect to the direction of travel of the chain, and outwardly away from the longitudinal axis of the chain;

a second, trench face-shearing L-shaped tooth mounted on said chain and spaced therealong from said first, leading trench face-shearing tooth, said second, trench face-shearing L-shaped tooth having a second tooth shank portion connected to the outer side of a second one of said tooth-mounting plates spaced along said chain from said one tooth mounting plate, and also located on said one side of said chain, said second L-shaped tooth having a toe portion extending generally transversely with respect to the direction of travel of said chain, and inwardly toward the longitudinal axis of the chain, said toe portion of said second L-shaped tooth being positioned behind, and in a shielded location with respect to, said first trench face-shearing tooth;

at least one additional pair of L-shaped teeth located rearwardly of, and spaced from, said first and second L-shaped teeth, and positioned relative to each other to facilitate shielding of one of the L-shaped teeth in each of said additional pairs by the other of said L-shaped teeth in each of said additional pairs;

at least one pair of transversely aligned L-shaped teeth, including in each such pair of transversely aligned L-shaped teeth, two L-shaped teeth aligned with each other transversely across said chain along a line extending normal to said chain axis, and said line passing between two L-shaped teeth spaced from each other along said chain; and at least one pair of transversely aligned cup-shaped teeth spaced along said chain from all of said L-shaped teeth, said cup-shaped teeth being at least as widely spaced from each other in a transverse direction with respect to said chain, and along a line extending normal with respect to said chain axis, as the transverse spacing across said chain between any two L-shaped teeth transversely aligned with each other on opposite sides of the chain, and on a line extending normal to the longitudinal axis of the chain, whereby said cup-shaped teeth function as gauge teeth establishing the width of a trench excavated by said chain.

13. An endless trenching chain assembly for use on a trenching machine for continuously forming and advancing a trench having a face and a pair of laterally-shaped, substantially parallel side walls, the trenching chain assembly comprising:

an elongated, endless chain having opposite sides and having a lengthwise aspect and a width, and having a centrally disposed longitudinal axis extending along its length between opposite sides of the chain for extension parallel to the side walls of the trench, said chain further including a plurality of interconnected, articulated links extending successively along the lengthwise aspect of the chain, said links including lateral plates located at opposite sides of the chain, and shaft means interconnecting said lateral plates and defining spaced sprocket tooth-receiving openings along the length of the chain; and a plurality of generally L-shaped shearing teeth secured at spaced intervals along the chain, said shearing teeth each including:

a toe portion extending at an angle of about 105° to a plane containing the longitudinal axis of the chain and said plane extending substantially parallel to the vertical side walls of the trench dug by the chain, said toe portion further including a convex outer side, and a concave inner side spaced closer to the chain than the outer side by the amount of the thickness of the toe portion, said toe portion further including a leading, cutting edge beveled to a sharpened edge at one side thereof;

a shank portion connected to the toe portion and secured to the chain in a position to space the toe portion outwardly from the chain; and hard-facing on the convex outer side of said toe portion adjacent said leading, cutting edge thereof, and on said shank portion at a location immediately adjacent the convex outer side of said toe portion.

14. An endless trenching chain assembly as defined in claim 13 wherein said shaft means interconnecting said lateral plates comprises a plurality of bolts spaced at intervals along the chain and defining, by their spacing, the pitch of said chain.

15. An endless trenching chain assembly as defined in claim 13 wherein said shank portion and toe portion are interconnected along a line of intersection and define between them an angle of from about 60° to about 120° , and wherein said shank portion has a leading edge, a trailing edge and a securement edge intersecting the leading and trailing edge and extending perpendicular to said leading edge, said securement edge being spaced across said shank portion from said line of intersection, and wherein each of said shearing teeth has a height, as measured from its securement edge to the portion of the outer side of said toe portion which is furthest from said chain, which is from about 1.4 to about 2.5 times the pitch of said chain, so that the height to pitch ratio is from about 1.4 to about 2.5.

16. A trenching chain assembly comprising:

an elongated endless chain having opposite sides and having a lengthwise aspect and a width, and said elongated endless chain further having a centrally disposed longitudinal axis extending along its length between opposite sides of the chain, said chain including:

a plurality of pivotally interconnected, articulated links having a plurality of longitudinally spaced, tooth-mounting plates each adapted to support a digging tooth, a plurality of said tooth-mounting plates being located on opposite sides of the longitudinal axis of the chain, and generally defining, by their separation, the width of the chain; and an array of digging teeth secured to, and projecting from, the chain and a plurality of said tooth mounting plates being located on the same side of the longitudinal axis of the chain, the array of digging teeth including:

a first L-shaped, trench face shearing tooth mounted on one of said tooth-mounting plates on one side of said chain, and including:

a shank portion secured to said plate and having a leading edge and a trailing edge;

a toe portion secured to said shank portion and spaced outwardly from the chain by said shank portion and oriented at an angle of from about 60° to about 120° with respect to said shank portion, and oriented to scrape against a trench face disposed at the leading end of said chain, said toe portion having a sharpened leading cutting edge aligned with the leading edge of said shank portion;

a hard surface adjacent the sharpened leading edge of said toe portion;

a second L-shaped trench face shearing tooth disposed on the opposite side of said chain from said first L-shaped tooth, said second L-shaped tooth mounted on a second of said tooth-mounting plates located on the opposite side of the chain from said one tooth-mounting plate and including:

a shank portion having a leading edge and a trailing edge, said shank portion of the second L-shaped tooth being secured to said second tooth-mounting plate a toe portion secured to said shank portion of the second L-shaped tooth and spaced outwardly from said second plate by said shank portion of the second L-shaped tooth, and oriented at an angle of from about 60° to about 120° to said shank portion of the second L-shaped tooth, and oriented to scrape against a trench face ahead of said chain, said toe portion of the second L-shaped tooth having a sharpened leading cutting edge aligned with the leading edge of said shank portion of the second L-shaped tooth;

a hardened surface area adjacent the sharpened leading edge of said toe portion of the second L-shaped tooth, said toe portion of said second L-shaped trench face shearing tooth extending in the opposite direction from the direction of extension of the toe portion of said first L-shaped trench face shearing tooth and being located substantially the same distance outwardly from the longitudinal axis of said chain as the toe portion of said first L-shaped tooth;

a first cup-shaped gauge tooth for scraping the side walls of the trench formed by said chain mounted on said chain and spaced longitudinally therealong from each of said L-shaped trench face shearing teeth, said first cup-shaped gauge tooth having;

a shank portion secured to a third of said tooth-mounting plates spaced longitudinally along the chain from said first and second tooth mounting plates;

a C-shaped portion joined to said last mentioned shank portion and spaced thereby from said third tooth-mounting plate outwardly in a direction away from the axis of said chain, said C-shaped portion having a leading edge facing toward said L-shaped teeth, and said C-shaped portion having a convex outer surface facing toward, and adapted to bear against, the wall of a trench being formed by said apparatus, and said C-shaped portion further having a concave inner surface facing inwardly toward the axis of said chain; and a hard-facing material on the leading edge of said first cup-shaped gauge tooth; and a second cup-shaped gauge tooth for scraping the side wall of a trench formed by said apparatus mounted on said chain and spaced longitudinally therealong from each of said first and second L-shaped trench face shearing teeth, said second cup-shaped gauge tooth having;

a shank portion secured to a fourth of said tooth-mounting plates;

a C-shaped portion joined to said last-mentioned shank portion and spaced outwardly from said fourth tooth-mounting plate by said last-mentioned shank portion, said C-shaped portion having a leading edge facing toward said L-shaped teeth and having convex, outwardly facing surface facing toward, and adapted to bear against, the side wall of a trench being formed by said trenching chain assembly, and having a concave, inwardly facing surface; and a hard facing material on the leading edge of said second cup-shaped gauge tooth.

* * * * *

UNITED STATES PATENT AND TRADEMARK OFFICE

CERTIFICATE OF CORRECTION

PATENT NO. : 4,924,609

DATED : May 15, 1990

INVENTOR(S) : J. Scott Martin

It is certified that error appears in the above-identified patent and that said Letters Patent is hereby corrected as shown below:

In the Claims:
In Column 18, line 32, change "siad" to --said--.
In Column 21, line 34, change "shaped" to --spaced--

In Column 22, line 68, add a semicolon after "plate".

Signed and Sealed this

First Day of October, 1991

*Attest:*

HARRY F. MANBECK, JR.

*Attesting Officer*

*Commissioner of Patents and Trademarks*